US006193551B1

(12) United States Patent
Yamamoto et al.

(10) Patent No.: US 6,193,551 B1
(45) Date of Patent: Feb. 27, 2001

(54) CONNECTOR

(75) Inventors: Masaya Yamamoto; Takayoshi Endo, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/369,151

(22) Filed: Aug. 5, 1999

(30) Foreign Application Priority Data

Aug. 7, 1998 (JP) ..... 10-223975

(51) Int. Cl.[7] ..... H01R 13/40
(52) U.S. Cl. ..... 439/595; 439/752
(58) Field of Search ..... 439/595, 744, 439/752

(56) References Cited

U.S. PATENT DOCUMENTS 5,141,452 * 8/1992 Yoneda et al. ..... 439/595
5,145,419 * 9/1992 Yamanashi et al. ..... 439/752
5,782,657 * 7/1998 Wolla et al. ..... 439/595

FOREIGN PATENT DOCUMENTS 2-567958 1/1998 (JP) .

* cited by examiner

*Primary Examiner*—Brian Sircus
*Assistant Examiner*—P. Dinh
(74) *Attorney, Agent, or Firm*—Armstrong, Westerman, Hattori, McCleland & Naughton, LLP

(57) ABSTRACT

Elastic retaining lances ($16_1$, $16_2$), provided in a connector housing (2), serve also as partition walls of terminal receiving chambers (3), and project into the terminal receiving chambers (3). Slanting partition walls ($10_1$, $10_2$) are disposed rearwardly of the retaining lances ($16_1$, $16_2$) in continuous relation thereto, and the slanting partition walls ($10_1$, $10_2$) are continuous with horizontal rear partition walls ($9_1$, $9_2$). Front partition walls ($22_2$, $22_3$) are disposed forwardly of the retaining lances ($16_1$, $16_2$), and are disposed respectively at levels equal respectively to levels of the rear partition walls ($9_1$, $9_2$), and each of the front partition walls ($22_2$, $22_3$) has a tapering guide surface (**22*a*) for urging a distal end of the terminal in a direction of flexion of the retaining lance ($16_1$, $16_2$). The distance ($L_4$) between the front partition walls ($22_2$, $22_3$) is at least the sum of a height of the terminal and a margin ($L_1$) for the flexion of the retaining lance ($16_1$). The front partition walls ($22_2$, $22_3$) are formed on a front holder (4). The slanting partition walls ($10_1$, $10_2$) are formed on a terminal-retaining spacer (6), and serve also as terminal-retaining walls. The terminal includes a first engagement step portion for engagement with the retaining lance ($16_2$), and a second engagement step portion for engagement with the slanting partition wall ($10_2$**), and the second engagement step portion is lower in height than the first engagement step portion.

13 Claims, 4 Drawing Sheets

CONNECTOR

BACKGROUND OF THE INVENTION

1. Field of the Invention

The present invention relates to a connector in which retaining lances for retaining terminals serve also as partition walls, separating terminal receiving chambers in a housing from one another, thereby achieving a compact design in a direction of the height of the connector.

The present application is based on Japanese Patent Application No. Hei. 10-223975, which is incorporated herein by reference.

2. Description of the Related Art

FIGS. 7 to 10 show the related connector that has been disclosed in Japanese Utility Model No. 2567958. FIG. 7 is a vertical cross-sectional view of the related connector, FIG. 8 is a vertical cross-sectional view of the related connector, showing a condition in which terminals are inserted therein, FIG. 9 is a cross-sectional view taken along the line IX—IX of FIG. 7, and FIG. 10 is a cross-sectional view taken along the line X—X of FIG. 8.

In this connector 41 (FIG. 8), a receiving recess 46 (FIG. 9) for receiving a reinforcing projection 45*a* of an elastic retaining lance 45 is formed in a partition wall 44 of each terminal receiving chamber 43 in a connector housing 42, and with this construction a compact design of the connector housing 42 in the direction of the height thereof is achieved while securing a margin for the flexion of the retaining lance 45.

The retaining lance 45 serves to retain a terminal 47 (FIG. 8), and extends obliquely upwardly from the partition wall 44, and has a retaining projection 45*b* formed at its distal end for engagement in an engagement hole 48 in the terminal 47. A flexing space 49 is formed at the lower side of the retaining lance 45. The reinforcing projection 45*a* is formed integrally on the lower side of the retaining lance 45, and the receiving recess 46 for receiving the reinforcing projection 45*a* is formed through the partition wall 44.

When the terminal 47 is inserted into the terminal receiving chamber, the retaining lance 45 is displaced into the flexing space 49, and the reinforcing projection 45*a* is engaged in the receiving recess 46, and the lower surface of the retaining lance 45 is held against the upper surface of the partition wall 44, thereby preventing excessive displacement of the retaining lance 45. Simultaneously when the insertion of the terminal 47 is completed, the retaining lance 45 is restored upwardly to retain the terminal 47.

In the above-described connector 41, although part (the reinforcing projection 45*a*) of the retaining lance 45 is inserted into the recess in the partition wall 44, thereby increasing the flexing margin, the amount of this increase is only an amount corresponding to the height of the reinforcing projection 45*a*, and this could not achieved a sufficient effect with respect to the compact design in the direction of the height of the connector housing 42. And besides, because of the reduced thickness of the retaining lance 45, the reinforcing projection 45*a* is formed on the retaining lance 45, and also the engagement recess 46 is formed in the partition wall 44, and therefore there has been encountered a problem that the construction is complicated.

SUMMARY OF THE INVENTION

With the above problems in view, it is an object of the present invention to provide a connector in which a more compact design in a direction of a height of a connector housing is achieved, and the construction of the connector is simple, and the rigidity of retaining lances is not reduced.

To achieve the above object, according to the first aspect of the present invention, there is provided a connector which comprises a connector housing including a plurality of terminal receiving chambers into which terminals are respectively insertable, the terminal receiving chambers having horizontal rear partition walls, a plurality of elastic retaining lances that retain the terminals in the terminal receiving chambers, respectively, wherein the retaining lances serve as partition walls of terminal receiving chambers, and project into the terminal receiving chambers, a plurality of slanting partition walls respectively located rearwardly of the retaining lances, the slanting partition walls being respectively extended toward the retaining lances and the horizontal rear partition walls, a plurality of front partition walls respectively located forwardly of the retaining lances, the front partition walls being disposed at respective levels equal to respective levels of the rear partition walls, and a plurality of tapering guide surfaces respectively formed on the front partition walls, wherein each of the tapering guide surfaces urges a distal end of each of the terminals in a direction of flexion of each of the retaining lances.

According to the second aspect of the present invention, preferably, a distance between adjacent two of the front partition walls is at least the sum of a height of the related one of the terminals and a margin for flexion of the related one of the retaining lances.

According to the third aspect of the present invention, the connector may further comprise a front holder attachable to the connector housing. In this case, preferably, the front partition walls are formed on the front holder.

According to the fourth aspect of the present invention, the connector may further comprise a terminal-retaining spacer insertable into the connector housing. In this case, preferably, the slanting partition walls are formed on the terminal-retaining spacer to retain the respective terminals when the terminal-retaining spacer is inserted into the connector housing.

According to the fifth aspect of the present invention, preferably, each of the terminals includes a first engagement step portion for engagement with each of the retaining lances, and a second engagement step portion for engagement with each of the slanting partition walls, and the second engagement step portion is lower in height than the first engagement step portion.

DETAILED DESCRIPTION OF THE PREFERRED EMBODIMENT

Figure 1:
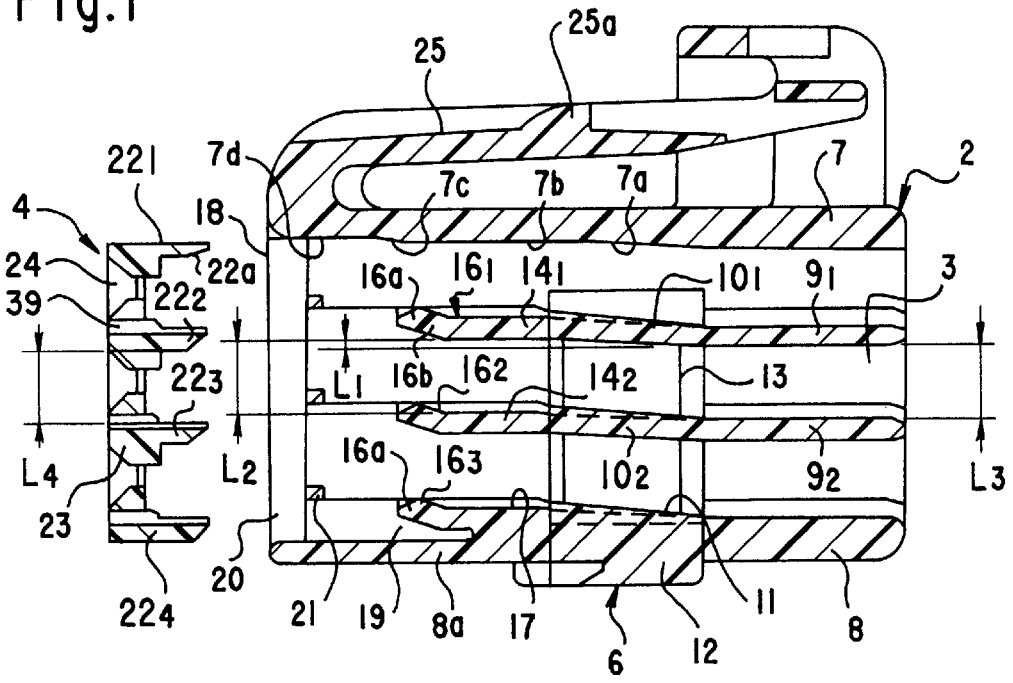
FIG. 1 is a vertical cross-sectional view of a preferred embodiment of a connector of the present invention, showing a connector housing and a front holder.

A preferred embodiment of the present invention will now be described in detail with reference to FIGS. 1 to 6.

FIGS. 1 to 6 show one preferred embodiment of a connector of the present invention.

This connector 1 (FIG. 4) comprises a connector housing 2 made of a synthetic resin, a front holder 4 of a synthetic resin defining front portions of terminal receiving chambers 3 at a front portion of the connector housing 2, female terminals 5 inserted into the terminal receiving chambers 3 from the rear side thereof, and a terminal-retaining spacer 6 of a synthetic resin inserted into the connector housing 2 from the lower side thereof in a direction perpendicular to the terminal receiving chambers 3.

As shown in FIG. 1, the connector housing 2 of this embodiment has the terminal receiving chambers 3 arranged in three rows in the direction of the height. At a rear half portion of the connector housing 2, two rear partition walls $\mathbf{9}_1$ and $\mathbf{9}_2$ are formed horizontally between an upper wall 7 and a lower wall 8 of the connector housing 2. The rear partition walls $\mathbf{9}_1$ and $\mathbf{9}_2$ are continuous respectively with partition walls $\mathbf{10}_1$ and $\mathbf{10}_2$ of the spacer 6 slanting obliquely upwardly toward the front side. The lower wall 8 is continuous with a slanting wall 11 of the spacer 6 slanting obliquely upwardly toward the front side.

Namely, the spacer 6 includes the two slanting partition walls $\mathbf{10}_1$ and $\mathbf{10}_2$, forming the terminal receiving chambers 3 at that portion of the connector housing 2 disposed midway in the terminal inserting direction, and the slanting wall 11 formed integrally with an operating portion 12 formed at a lower end of the spacer 6. The slanting partition walls $\mathbf{10}_1$ and $\mathbf{10}_2$ are disposed perpendicular to a vertically-disposed base plate 13. The slanting partition walls $\mathbf{10}_1$ and $\mathbf{10}_2$ form part of the partition walls of the terminal receiving chambers 3. In FIG. 1, the spacer 6 is provisionally retained on the connector housing 2 by provisionally-retaining means (not shown).

At a front half portion of the connector housing 2, the slanting partition walls $\mathbf{10}_1$ and $\mathbf{10}_2$ of the spacer 6 are continuous respectively with horizontal partition walls $\mathbf{14}_1$ and $\mathbf{14}_2$ formed integrally with the connector housing 2. Elastic retaining lances $\mathbf{16}_1$, $\mathbf{16}_2$ extend forwardly from each of the partition walls $\mathbf{14}_1$ and $\mathbf{14}_2$, and each of these lances has at its distal end a retaining portion 16*a* slanting obliquely upwardly toward the front side. The slanting wall 11 of the spacer 6 is continuous with a horizontal wall 17 formed integrally with the lower wall 8 of the connector housing 2, and this wall 17 is continuous with elastic retaining lances $\mathbf{16}_3$ each having a retaining portion 16*a* slanting obliquely upwardly toward the front side. Each of the retaining lances $\mathbf{16}_1$ to $\mathbf{16}_3$ includes a horizontal straight portion 16*b*, continuous with the partition wall $\mathbf{14}_1$, $\mathbf{14}_2$ or the wall 17, and the retaining portion (slanting portion) 16*a* extending obliquely upwardly from the horizontal portion 16*b*.

The retaining lances $\mathbf{16}_1$ and $\mathbf{16}_2$, disposed midway in the direction of the height of the connector housing 2, also serve as partition walls of the terminal receiving chambers 3 at the front portion of the connector housing 2. A flexing space (flexing margin), having a distance $L_1$ in the direction of the height, is formed at the lower side of each of the retaining lances $\mathbf{16}_1$ and $\mathbf{16}_2$. $L_1$ represents the distance between the lower surface of the retaining lance $\mathbf{16}_1$ and the lower surface of the rear partition wall $\mathbf{9}_1$ of the connector housing 2. The distance $L_2$ between the retaining lances $\mathbf{16}_1$ and $\mathbf{16}_2$ (that is, the distance between the lower surf ace of the upper retaining lance $\mathbf{16}_1$ and the upper surface of the lower retaining lance $\mathbf{16}_2$) is equal to the distance $L_3$ between the rear partition walls $\mathbf{9}_1$ and $\mathbf{9}_2$ of the connector housing (that is, the distance between the lower surface of the upper rear partition wall $\mathbf{9}_1$ and the upper surface of the lower rear partition wall $\mathbf{9}_2$).

The upper wall 7 of the connector housing 2 includes a slanting surface 7*a*, slanting at the same angle as that of the upper slanting partition wall $\mathbf{10}_1$ of the spacer 6 in opposed relation thereto, a horizontal surface 7*b*, disposed in opposed relation to the front partition wall $\mathbf{14}_1$ of the connector housing 2 and the horizontal portion 16*b* of the retaining lance $\mathbf{16}_1$, and an upwardly-slanting surface 7*c* disposed in opposed relation to the retaining portion 16*a* of the retaining lance $\mathbf{16}_1$. The slanting surface 7*c* is continuous with a horizontal surface 7*d* disposed forwardly thereof, and the horizontal surface 7*d* is continuous with a front opening 18 in the connector housing 2. The lower wall 8 is reduced in thickness at its portion disposed beneath the retaining lance $\mathbf{16}_3$, and a lance flexing space 19 is formed between this horizontal, reduced-thickness portion 8*a* and the retaining lance $\mathbf{16}_3$. The reduced-thickness portion 8*a* is continuous with the front opening 18.

A receiving space 20 for the front holder 4 is formed at the front opening 18 in the connector housing 2. Stopper projections 21 for stopping the front holder 4 are formed on an inner surface of the receiving space 20. The front holder 4 is inserted into the connector housing 2 through the front opening 18, and is retained by retaining means (not shown).

The front holder 4 includes four partition walls $\mathbf{22}_1$ to $\mathbf{22}_4$ spaced from one another in the direction of the height in parallel relation, these partition walls forming the front portions of the terminal receiving chambers 3. The uppermost partition wall $\mathbf{22}_1$ is disposed in contact with the horizontal surface 7*d* of the upper wall 7 of the connector housing 2, and the lowermost partition wall $\mathbf{22}_4$ is disposed along the reduced-thickness portion 8*a* of the lower wall 8 of the connector housing 2; The two intermediate partition walls $\mathbf{22}_2$ and $\mathbf{22}_3$ are disposed respectively at the same levels or heights as those of the rear partition walls $\mathbf{9}_1$ and $\mathbf{9}_2$ of the connector housing 2. Each of the upper three partition walls $\mathbf{22}_1$ to $\mathbf{22}_3$ has a tapering guide surface 22*a* (for guiding the terminal 5 (FIG. 3) formed on a lower surface of its distal end.

The distance $L_4$ between any two adjacent partition walls (that is, the distance between the lower surface of the upper partition wall $\mathbf{22}_2$ and the upper surface of the lower partition wall $\mathbf{22}_3$) is equal to the distance $L_2$ and the distance $L_3$. The distance $L_2$ and the distance $L_4$ include the flexing margin $L_1$ for the retaining lance $\mathbf{16}_1$. Therefore, the distal end portion of the terminal 5 (FIG. 3) can be flexed between the partition walls of the front holder 4 by an amount corresponding to the distance $L_1$. The flexing margin for the retaining lance $\mathbf{16}_1$ is secured by the distance $L_4$ between the partition walls of the front holder 4.

Figure 2:
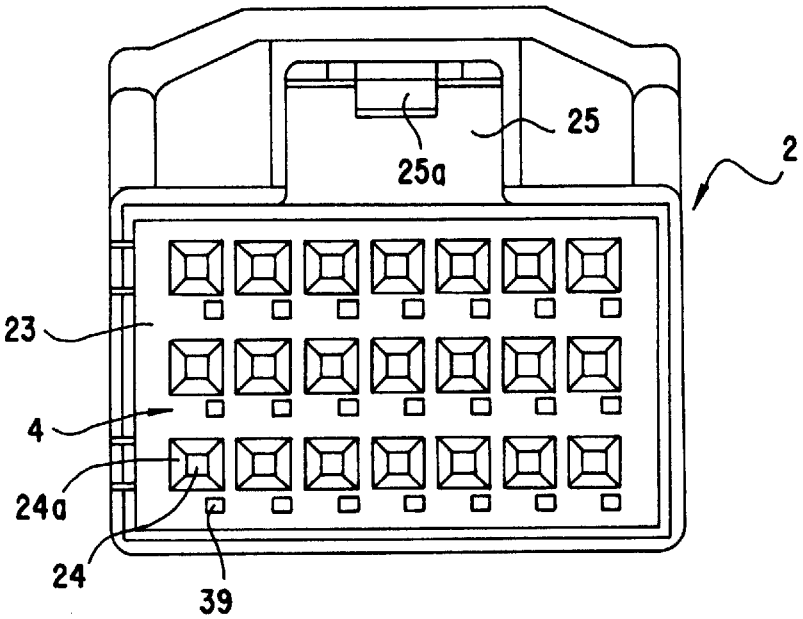
FIG. 2 is a front-elevational view showing a condition in which the front holder is attached to the connector housing.

As shown in FIG. 2, insertion holes 24 for male terminals of a mating connector (not shown), as well as jig rod-inserting holes 39 for canceling the retaining engagement of the retaining lance, are formed through a front wall 23 of the front holder 4. The front wall 23 of the front holder 4 also serves as a front end wall of the connector housing 2. A tapering guide surface 24*a* is formed on a front end of each insertion hole 24. The connector housing 2 is locked to a mating connector housing (not shown) by a lock projection 25*a* of an elastic lock arm 25.

Figure 3B:
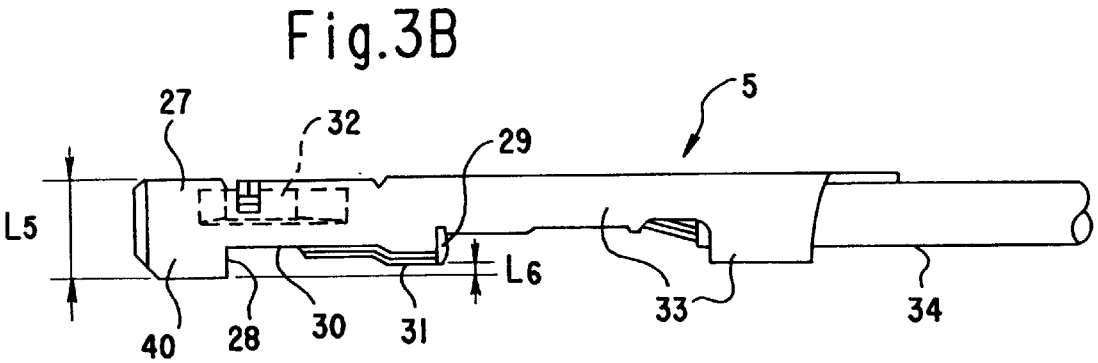
FIG. 3B is a side-elevational view of the terminal;.
Figure 3A:
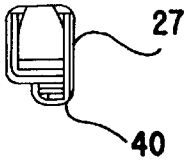
FIG. 3A is an end view of a terminal.

As shown in FIGS. 3A and 3B, the terminal 5 includes an electrical contact portion 27 of a generally rectangular tubular shape, and a first engagement step portion 28 for engagement with the retaining lance 161 (FIG. 1) is formed at a front portion of the electrical contact portion 27, and a second engagement step portion 29 for engagement with the spacer 6 (FIG. 1) is formed at a rear portion of the electrical contact portion 27. The first engagement step portion 28 is formed at a rear end of a first projection 40 formed at the front portion of the terminal. The first engagement step portion 28 is continuous with a horizontal surface 30 of the electrical contact portion 27, and the horizontal surface 30 is continuous with a second projection 31 projecting slightly outwardly therefrom, and the second engagement step portion 29 is formed at a rear end of the second projection 31.

The first projection 40 of the electrical contact portion 27 has a maximum terminal height $L_5$. A step, having the distance $L_6$ in the direction of the height, is formed between the first projection 40 and the second projection 31 disposed rearwardly thereof. For example, a contact spring piece 32 is provided within the electrical contact portion 27. A wire 34 is fastened and connected to a clamp portion 33 provided at the rear end of the terminal 5.

Figure 4:
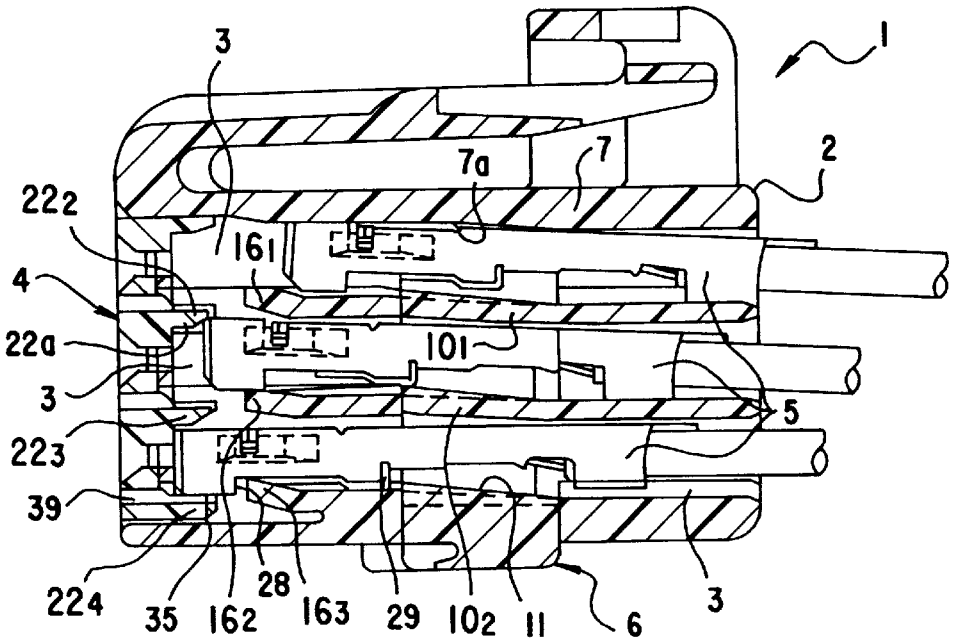
FIG. 4 is a vertical cross-sectional view showing the manner of inserting the terminal into the connector housing.

As shown in FIG. 4, the terminals 5 are inserted into the respective terminal receiving chambers 3. In FIG. 4, for convenience' sake, the process of inserting one terminal 5 into one terminal receiving chamber 3 is shown in a sequential manner, using three terminal receiving chambers 3.

First, as in the upper-stage terminal receiving chamber 3, the terminal 5 is inserted slightly obliquely upwardly into the terminal receiving-chamber along the slanting partition wall $\mathbf{10}_1$ of the spacer 6 and the slanting surface 7*a* of the upper wall 7 of the connector housing 2. As in the intermediate-stage terminal receiving chamber 3, the terminal 5 further advances obliquely upwardly along the retaining lances $\mathbf{16}_1$ and $\mathbf{16}_2$, and enters the flexing space for the upper retaining lance $\mathbf{16}_1$. Then, the upper side of the distal end of the terminal 5 strikes against the downwardly-directed tapering guide surface 22*a* of the partition wall $\mathbf{22}_2$ of the front holder 4. As a result, the terminal 5 is pressed down, so that the retaining lance 162 is flexed downwardly by an amount corresponding to the distance $L_1$ (FIG. 1), and therefore as in the lower-stage terminal receiving chamber 3, the distal end of the terminal 5 is guided by the partition walls $\mathbf{22}_3$ and $\mathbf{22}_4$ of the front holder 4, so that the terminal 5 is smoothly and positively inserted into the proper position.

The retaining lance 163 is restored upwardly to engage the first engagement step portion 28, thereby effecting the primary retaining of the terminal 5. A gap 35 is present at the lower side of the distal end portion of the terminal 5 disposed between the upper and lower partition walls $\mathbf{22}_3$ and $\mathbf{22}_4$ of the front holder 4. By inserting a jig rod into the gap 35 through the inserting hole 39 continuous with the gap 35, the retaining engagement of the retaining lance $\mathbf{16}_3$ can be canceled.

As described above, the retaining lances $\mathbf{16}_1$ and $\mathbf{16}_2$ form part of the partition walls, and isolate and insulate the upper and lower terminals 5 from each other, and thus the retaining lances $\mathbf{16}_1$ and $\mathbf{16}_2$ serve also as the partition walls of the terminal receiving chambers 3. Therefore, the construction of the connector housing 2 is simplified, and the compact design of the connector housing 2 in the direction of the height is achieved. And besides, during the insertion of the terminal 5, the terminal 5 moves in an inclined manner, utilizing the flexing space for the upper retaining lance $\mathbf{16}_1$, and therefore the pitch of the terminal receiving chambers 3 is much reduced as compared with the related construction in the background section, and the dimension of the connector housing 2 in the direction of the height is much reduced.

In FIG. 4, finally, the spacer 6 is pushed and moved upward transversely of the terminals 5. As a result, the slanting partition walls $\mathbf{10}_1$ and $\mathbf{10}_2$ and slanting wall 11 of the spacer 6 engage the second engagement step portions 29 of the terminals 5, respectively, thereby effecting the secondary retaining of the terminals 5. The slanting partition walls $\mathbf{10}_1$ and $\mathbf{10}_2$ of the spacer 6 serve as the partition walls of the terminal receiving chambers 3 and also as the terminal retaining walls, and with this arrangement, also, the construction is formed into a simplified and compact design. If the terminals 5 are inserted into the terminal receiving chambers 3 in the sequence from the upper-stage to lower-stage terminal receiving chambers, the retaining lances can be flexed by an amount larger than the distance $L_1$, thus securing the larger flexing margin.

Figure 5:
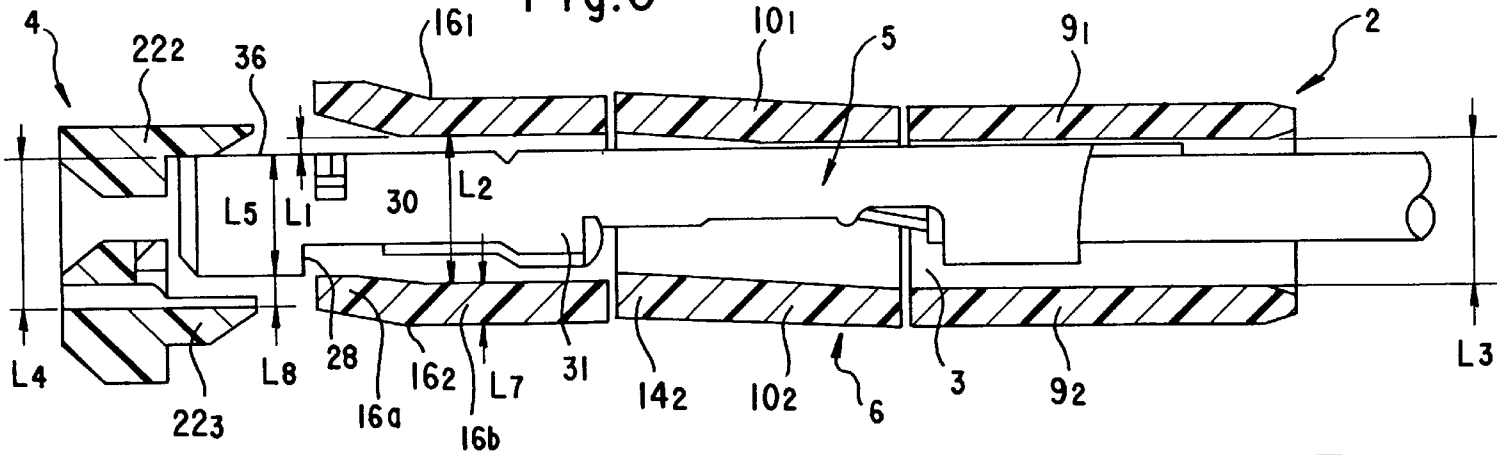
FIG. 5 is a vertical cross-sectional view of an important portion of the connector, showing a condition in which the terminal is inserted in a terminal receiving chamber.
Figure 7:
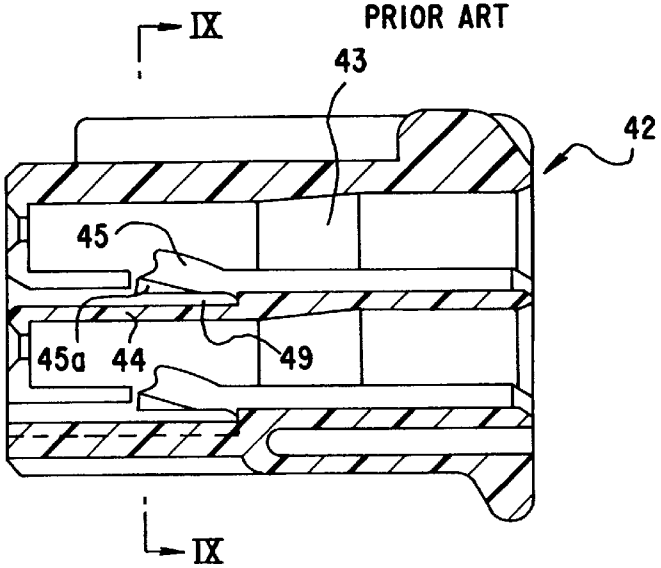
Fig.7 PRIOR ART
FIG. 7 is a vertical cross-sectional view of the related connector.

FIG. 5 shows the primarily-retained condition of the terminal 5. The upper surface of the horizontal portion 16*b* of the retaining lance 162 (more accurately, the upper surface of the horizontal partition wall $\mathbf{14}_2$ continuous with the horizontal portion 16*b*) is held in contact with the downwardly-directed second projection 31 of the terminal 5, and the obliquely upwardly-slanting retaining portion 16*a* of the retaining lance 162 are held in contact with the first engagement step portion 28 and the horizontal surface 30 (of the recessed portion) continuous with the engagement step portion 28. The terminal 5 is held in contact with the partition wall $\mathbf{14}_2$, and is urged upward by the retaining lance $\mathbf{16}_2$, and the upper surface 36 of the terminal 5 is held in contact with the lower surface of the partition wall $\mathbf{22}_2$ of the front holder 4 and the lower surface of the rear partition wall $\mathbf{9}_1$ of the connector housing 2.

As described above, the distance $L_4$ between the partition walls $\mathbf{22}_2$ and $\mathbf{22}_3$ of the front holder 4 is equal to the distance $L_3$ between the rear partition walls $\mathbf{9}_1$ and $\mathbf{9}_2$ of the connector housing 2. The upper surface of the horizontal portion 16 of the retaining lance $\mathbf{16}_2$, as well as the upper surface of the partition walls $\mathbf{14}_2$, projects a distance $L_7$ into the terminal receiving chamber 3 relative to the upper surface of the partition wall $\mathbf{22}_3$ of the front holder 4 and the upper surface of the rear partition wall $\mathbf{9}_2$. Namely, the retaining lance $\mathbf{16}_2$ is offset upwardly by the distance $L_7$. With this arrangement, the flexing space, having the distance $L_7$, is present between the upper retaining lance $\mathbf{16}_1$ and the upper surface 36 of the terminal 5. The lower retaining lance $\mathbf{16}_2$ is offset by the distance $L_7$ to project into the upper terminal receiving chamber 3. The distance $L_4$ between the partition walls of the front holder 4 is the sum of the height $L_5$ of the terminal 5 and the gap $L_8$, and the gap $L_8$ is generally equal to the flexing margin $L_1$ for the retaining lance $\mathbf{16}_1$ (more accurately, the gap is larger than $L_1$ by a margin). By thus determining these dimensions, the flexing margin and retaining margin (restoring margin) for the retaining lance $\mathbf{16}_1$ are secured in a space-saving manner.

Figure 6:
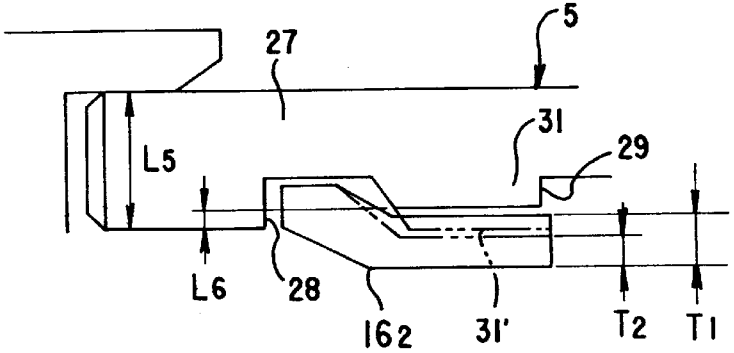
FIG. 6 is a side-elevational view showing the relation between the height of a second projection of the terminal and the thickness of a retaining lance.
Figure 8:
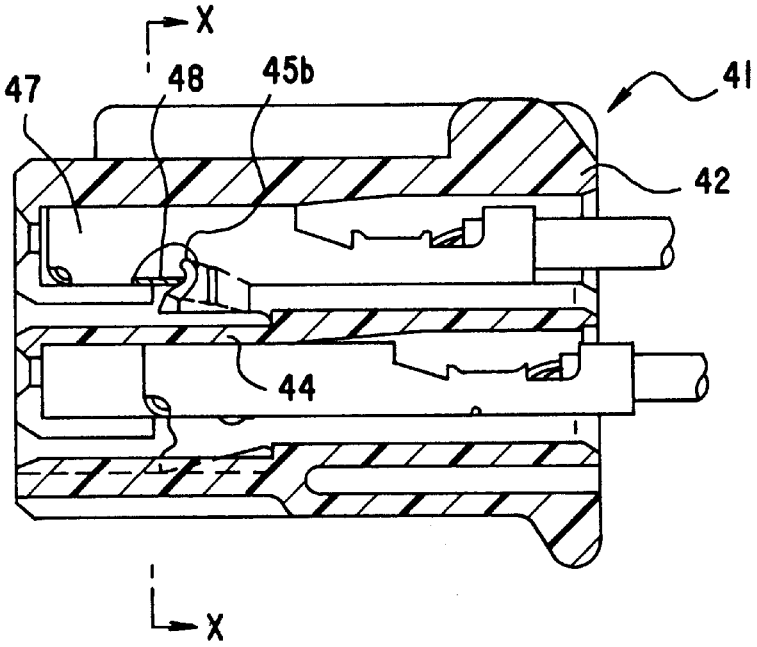
Fig.8 PRIOR ART
FIG. 8 is a vertical cross-sectional view of the related connector, showing a condition in which terminals are inserted therein.
Figure 9:
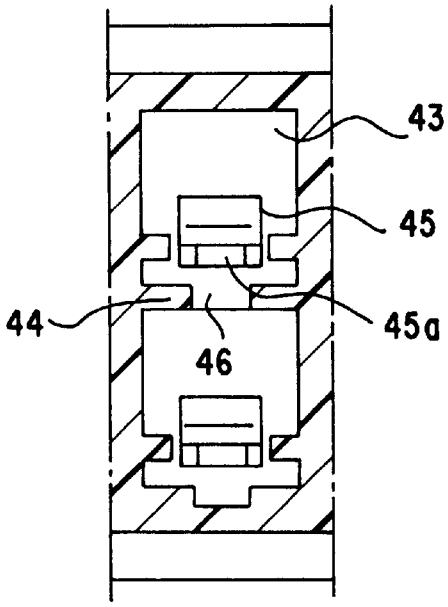
Fig.9 PRIOR ART
FIG. 9 is a cross-sectional view taken along the line IX—IX of FIG. 7.
Figure 10:
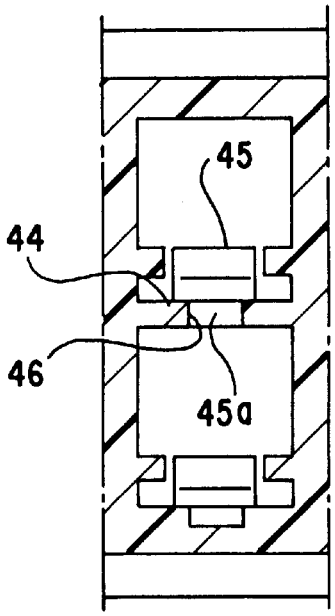
Fig.10 PRIOR ART
FIG. 10 is a cross-sectional view taken along the line X-X of FIG. 8.

If the height of the second projection 31 of the terminal 5 is equal to the height $L_5$ of the first projection 40 as indicated in a dots-and-dash line 31' in FIG. 6, the thickness $T_1$ of the retaining lance 162 is reduced to a thickness $T_2$, so that the strength of the retaining lance $\mathbf{16}_2$ is reduced. Therefore, the height of the second projection 31 of the terminal 5, having the second engagement step portion 29, is smaller by the distance $L_6$ than the height of the first projection 40 having the first engagement step portion 28, and this arrangement is effective in increasing the strength of the retaining lance $\mathbf{16}_2$.

In the above embodiment, the terminal double-retaining spacer 6 is used. In the type of construction in which the spacer 6 is not used, the rear partition walls $\mathbf{9}_1$ and $\mathbf{9}_2$ of the connector housing 2 can be extended in a slanting manner to form partition walls similar to the partition walls $\mathbf{10}_1$ and $\mathbf{10}_2$ of the spacer 6. The front holder 4 is used in order to facilitate the resin-molding of the connector. Without the use of the front holder 4, a front end wall, similar to the front wall 23 of the front holder 4, and partition walls, similar to the partition walls $\mathbf{22}_1$ to $\mathbf{22}_4$ each having the tapering guide surface 22*a*, can be formed integrally with the connector housing 2. The arrangement of the terminal receiving chambers 3 is not limited to three rows (three stages), and can be more than three rows. In the above embodiment, the terms "upper and lower" may be reversed or may be "right and left", depending on the arrangement of the connector 1.

As described above, in the present invention, the retaining lances completely serve also as the partition walls of the terminal receiving chambers, and therefore the thickness, corresponding to the thicknesses of partition walls in the related construction is eliminated, and the size of the connector housing in the direction of the height is much reduced, and besides the construction of the connector housing is simplified, and is less costly. And besides, during the insertion of the terminal, the terminal advances along the slanting partition wall, and enters the flexing space for the retaining lance, and abuts against the tapering guide surface of the front partition wall to be pressed down, thereby flexing the retaining lance. With this construction, the flexing space is efficiently used, and this also promotes the compact design in the direction of the height of the connector housing. In the present invention, the terminal, when pressed down, is moved between the front partition walls by an amount corresponding to the flexing margin for the retaining lance, thereby keeping the amount of flexion of the retaining lance and the retaining margin to a minimum. Therefore, the undue flexion of the retaining lance is prevented, and the compact design in the direction of the height of the connector housing is achieved, and also damage and settling of the retaining lance due to excessive displacement thereof are prevented. In the present invention, the construction of the connector housing is simplified, and besides the resin-molding of the connector housing and the front partition walls can be carried out easily and positively. In the present invention, the terminal double-retaining spacer serves also as the partition walls of the terminal receiving chambers, and therefore the construction of the connector housing is formed into a simplified and compact design. In the present invention, the thickness of the retaining lance can be increased by an amount corresponding to the difference in height between the first engagement step portion and the second engagement step portion lower than the first engagement step portion. Therefore, the thickness of the retaining lance can be increased, so that the rigidity of the retaining lance is increased, thus eliminating the reduced strength of the retaining lance liable to be encountered with the compact design.

What is claimed is:

1. A connector, comprising:

a connector housing including a plurality of terminal receiving chambers into which terminals are respectively insertable, the terminal receiving chambers having horizontal rear partition walls;

a plurality of elastic retaining lances that retain the terminals in the terminal receiving chambers, respectively, wherein the retaining lances serve as partition walls of terminal receiving chambers, and project into the terminal receiving chambers;

a plurality of slanting partition walls respectively located rearwardly [of] behind the retaining lances, the slanting partition walls being respectively extended toward the retaining lances and the horizontal rear partition walls;

a plurality of front partition walls respectively located forwardly of the retaining lances, the front partition walls being disposed at respective levels equal to respective levels of the rear partition walls; and a plurality of tapering guide surfaces respectively formed on the front partition walls, wherein each of the tapering guide surfaces is oriented so as to urge a distal end of each of the terminals in a direction of flexion of each of the retaining lances.

2. The connector of claim 1, wherein a distance between adjacent two of the front partition walls is at least the sum of a height of the related one of the terminals and a margin for flexion of the related one of the retaining lances.

3. The connector of claim 2, further comprising a front holder attachable to the connector housing, wherein the front partition walls are formed on the front holder.

4. The connector of claim 1, further comprising a front holder attachable to the connector housing, wherein the front partition walls are formed on the front holder.

5. The connector of claim 1, further comprising a terminal-retaining spacer insertable into the connector housing, wherein the slanting partition walls are formed on the terminal-retaining spacer to retain the respective terminals when the terminal-retaining spacer is inserted into the connector housing.

6. The connector of claim 2, further comprising a terminal-retaining spacer insertable into the connector housing, wherein the slanting partition walls are formed on the terminal-retaining spacer to retain the respective terminals when the terminal-retaining spacer is inserted into the connector housing.

7. The connector of claim 3, further comprising a terminal-retaining spacer insertable into the connector housing, wherein the slanting partition walls are formed on the terminal-retaining spacer to retain the respective terminals when the terminal-retaining spacer is inserted into the connector housing.

8. The connector of claim 4, further comprising a terminal-retaining spacer insertable into the connector housing, wherein the slanting partition walls are formed on the terminal-retaining spacer to retain the respective terminals when the terminal-retaining spacer is inserted into the connector housing.

9. The connector of claim 1, wherein each of the terminals includes a first engagement step portion for engagement with each of the retaining lances, and a second engagement step portion for engagement with each of the slanting partition walls, and the second engagement step portion is lower in height than the first engagement step portion.

10. The connector of claim 5, wherein each of the terminals includes a first engagement step portion for engagement with each of the retaining lances, and a second engagement step portion for engagement with each of the slanting partition walls, and the second engagement step portion is lower in height than the first engagement step portion.

11. The connector of claim 6, wherein each of the terminals includes a first engagement step portion for engagement with each of the retaining lances, and a second engagement step portion for engagement with each of the slanting partition walls, and the second engagement step portion is lower in height than the first engagement step portion.

12. The connector of claim 7, wherein each of the terminals includes a first engagement step portion for engagement with each of the retaining lances, and a second engagement step portion for engagement with each of the slanting partition walls, and the second engagement step portion is lower in height than the first engagement step portion.

13. The connector of claim 8, wherein each of the terminals includes a first engagement step portion for engagement with each of the retaining lances, and a second engagement step portion for engagement with each of the slanting partition walls, and the second engagement step portion is lower in height than the first engagement step portion.

* * * * *